US007629938B1

(12) United States Patent
Josypenko

(10) Patent No.: US 7,629,938 B1
(45) Date of Patent: Dec. 8, 2009

(54) OPEN YAGGI ANTENNA ARRAY

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 97 days.

(21) Appl. No.: 11/499,976

(22) Filed: Jul. 24, 2006

(51) Int. Cl.
*H01Q 21/12* (2006.01)

(52) U.S. Cl. ..... 343/815; 343/819

(58) Field of Classification Search ..... 343/811, 343/815, 819
See application file for complete search history.

(56) References Cited

U.S. PATENT DOCUMENTS 4,218,686 A * 8/1980 Blonder ..... 343/819
4,290,071 A * 9/1981 Fenwick ..... 343/819
4,514,734 A 4/1985 Cermignani et al.
5,220,335 A 6/1993 Huang
5,612,706 A 3/1997 Podell
5,629,713 A 5/1997 Mailandt et al.
5,712,643 A 1/1998 Skladany
5,898,410 A 4/1999 DeMarre
5,995,061 A 11/1999 Schiller
6,154,180 A 11/2000 Padrick
6,307,524 B1 * 10/2001 Britain ..... 343/795
6,839,038 B2 * 1/2005 Weinstein ..... 343/795

FOREIGN PATENT DOCUMENTS

JP 360074801 A 4/1985

* cited by examiner

*Primary Examiner*—Tan Ho
(74) *Attorney, Agent, or Firm*—James M. Kasischke; Jean-Paul A. Nasser; Michael P. Stanley

(57) ABSTRACT

An open Yaggi antenna array is disclosed wherein the reflector element and parasitic director elements of the antenna array are opened in line with the feed point of the driven element so that the reflector and director elements do not cause a shunting effect on the driven element of the antenna.

9 Claims, 7 Drawing Sheets

OPEN YAGGI ANTENNA ARRAY

STATEMENT OF GOVERNMENT INTEREST

The invention described herein may be manufactured and used by or for the Government of the United States of America for governmental purposes without the payment of any royalty thereon or therefore.

BACKGROUND OF THE INVENTION (1) Field of the Invention

The invention relates to antennas and is directed more particularly to a design for an open Yaggi antenna array.

(2) Description of the Prior Art

Most prior art Yaggi antennas consist of a driven element and two or more non-driven elements. The driven element is often a half-wave dipole. It is arranged in front of and parallel to a non-driven element that serves as a reflector. The driven element is also arranged behind and parallel to an array of one or more other parasitic elements that serve as directors. The reflector reflects radiation from the dipole back toward the dipole. The directors narrow the dipole radiation along the director side of the dipole. Both the driven and non-driven elements are all parallel on an axis along the same spatial plane.

The resultant radiation pattern of the Yaggi antenna as described above is a relatively narrow unidirectional beam along the direction of the director elements away from the dipole. The narrow beam effect produced by the reflector and directors occurs over approximately a 15% bandwidth about the half wavelength frequency of the dipole.

There are certain problems with the Yaggi antenna as described above. In particular, the reflector and directors have various undesirable effects on the original impedance of the dipole. The reflector and directors cause a "shunting effect" on the dipole, resulting in reduced antenna impedance in the region where the antenna operates, (at or near 0.5 wavelengths resonance). In addition, the reflector and directors also cause a decrease in the impedance bandwidth of the antenna. Since the directors are parasitic elements, they introduce undesirable resonance/anti-resonance loops in the original impedance of the dipole. What is needed, therefore, is a Yaggi antenna array design that avoids the shunting effect caused by the reflector element and parasitic director elements on the driven element.

SUMMARY OF THE INVENTION

The object of the present invention is, therefore, to provide an antenna with the performance of a traditional Yaggi array antenna but without any reduced antenna impedance and decreased bandwidth With the above and other objects in view, a feature of the present invention is an open Yaggi array antenna wherein the non-driven elements (reflector and directors) are opened in line with the feed point of the driven element (dipole) so that they do not shunt the driven element of the antenna. In this way the parasitic elements should only add the resonance/anti-resonance loops in the dipole impedance. The basic impedance of the dipole should remain the same.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENTS

Figure 1:
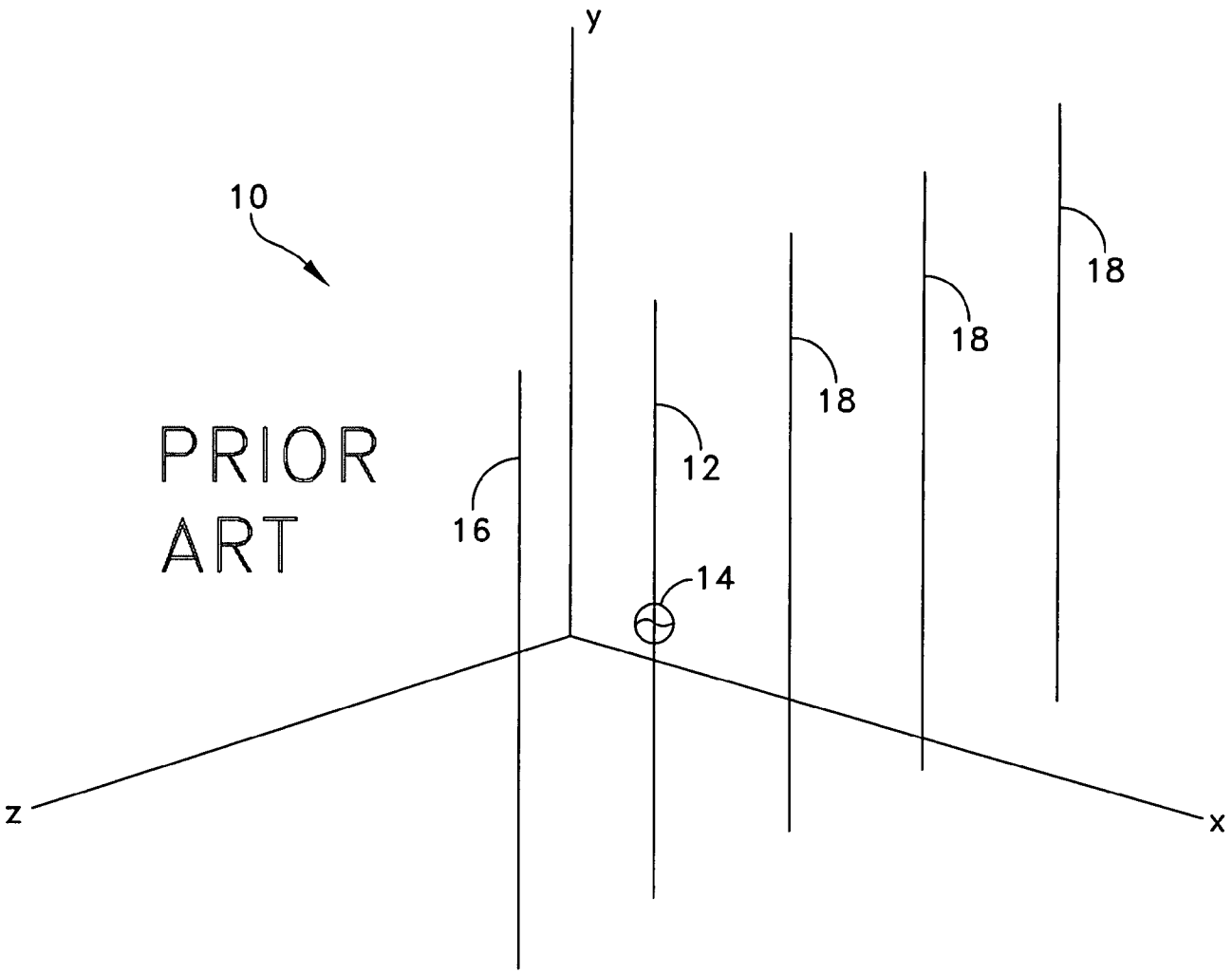
FIG. 1 illustrates an assembly for a traditional prior art yaggi antenna.

Referring to FIG. 1, there is shown an assembly for a traditional prior art Yaggi antenna 10. Yaggi antenna 10 includes a driven element 12, which is a 0.5 wavelengths dipole at 1 GHz, positioned vertically. The driven element 12 is a conducting rod having a radius of 0.0025 wavelengths, and having a feed point 14 at the center. Yaggi antenna 10 also includes a reflector element 16 having a length of 0.515 wavelengths, positioned parallel to the driven element 12, and several director elements 18 each having a length of 0.43 wavelengths, positioned parallel to and on an opposite side of the driven element 12. All of the antenna elements are arranged on the same plane of the antenna axis an equal distance apart 0.1 wavelengths at 1 GHz. Whereas this prior art Yaggi antenna 10 has many useful attributes, one drawback of the antenna 10 is that the non-driven elements, the reflector 16 and the directors 18 create a shunting effect on the driven element, the dipole 12 resulting in reduced antenna impedance, most importantly in the region where the antenna operates, at or near 0.5 wavelengths resonance.

Figure 2:
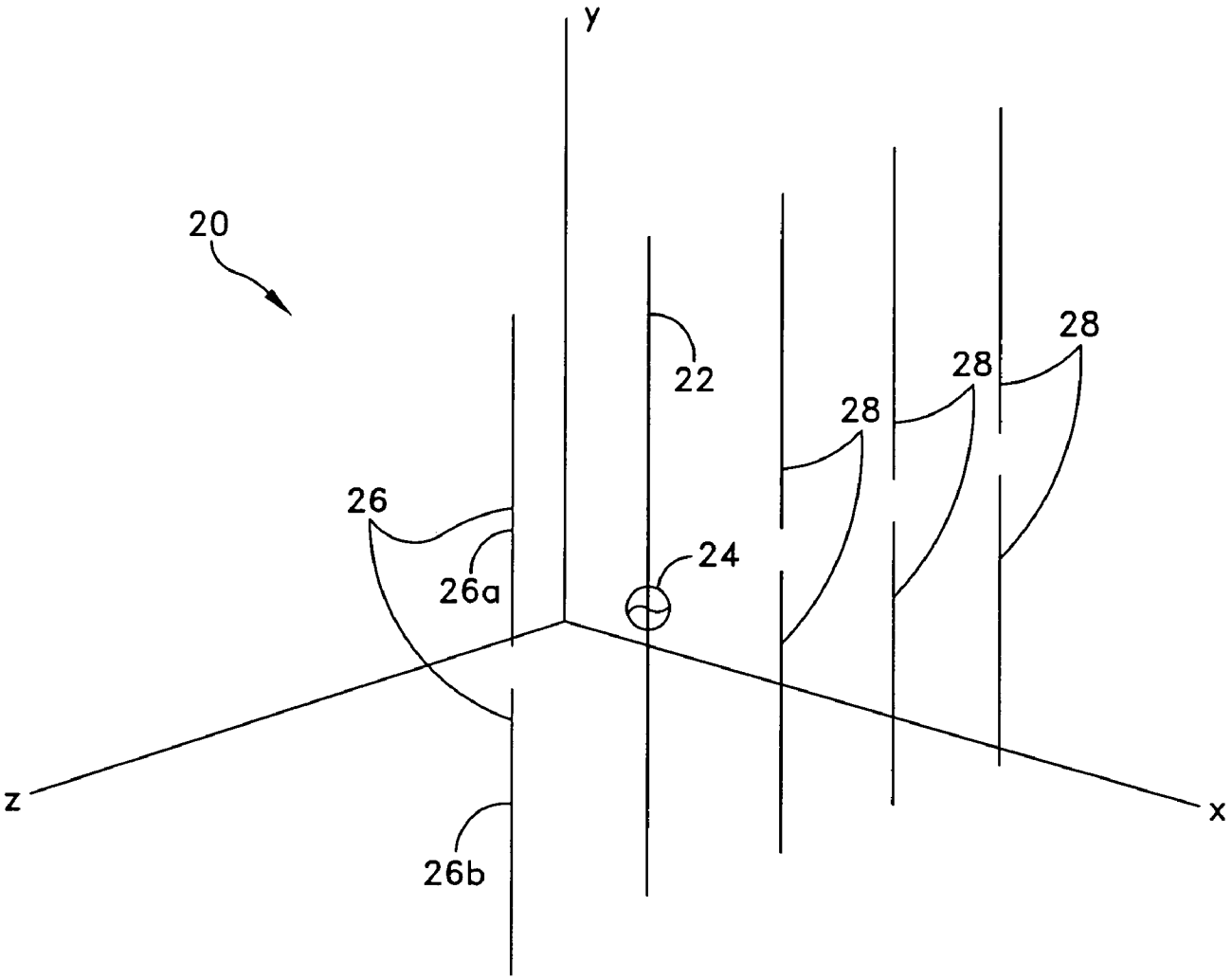
FIG. 2 illustrates a first embodiment of the present invention, an open yaggi antenna.

Referring to FIG. 2, there is shown a first embodiment of the present invention, an "open Yaggi" antenna 20. The open Yaggi antenna 20 also includes a driven element 22, which is a dipole having a feed point 24, a two piece reflector element 26 and one or more two piece director elements 28 all arranged on the same plane of the antenna axis an equal distance apart. For purposes of illustration the open Yaggi antenna 20 has three director elements 28, however, the invention is not limited to this number. The open Yaggi antenna 20 is designed to avoid the shunting effects of the non-driven elements on the dipole by opening up the reflector element 26 and the director elements 28 in line with the feed point 24 of the dipole 22 thereby creating a gap along the axis of the feed point 24.

By arranging the reflector element 26 and parasitic director elements 28 with a gap in line with the dipole feed point 24, the reflector element 26 and director elements 28 will only add to the resonance/anti-resonance loops in the dipole impedance. The basic impedance of the dipole will remain the same. To maintain the reflective properties of the reflector element 26, and the directive properties of the director elements 28, both types of parasitic elements are designed in two separate parts of equal length. The combined length of each two piece parasitic element is twice the length of the single piece element of the prior art Yaggi antenna 10 as illustrated in FIG. 1. For example reflector element 26 is a combination of elements 26*a* and 26*b* whose combined length is equal to twice that of reflector element 16.

In comparison to Yaggi antenna 10, the open Yaggi antenna 20 has the following dimensions. The driven element 22 dipole is positioned vertically. The maximum length of the dipole 22 is 2.0 wavelengths at 2 GHz or 1.0 wavelengths at 1 GHz. The diameter of the dipole 22 is 0.005 wavelengths at 1 GHz. Each of the two piece non-driven elements is approximately the same size as the driven element. The gap between the two pieces of each non-driven element is 0.025 wavelengths at 1 GHz. All of the open Yaggi antenna elements are arranged on the same plane of the antenna axis an equal distance apart 0.1 wavelengths at 1 GHz.

Figure 3:
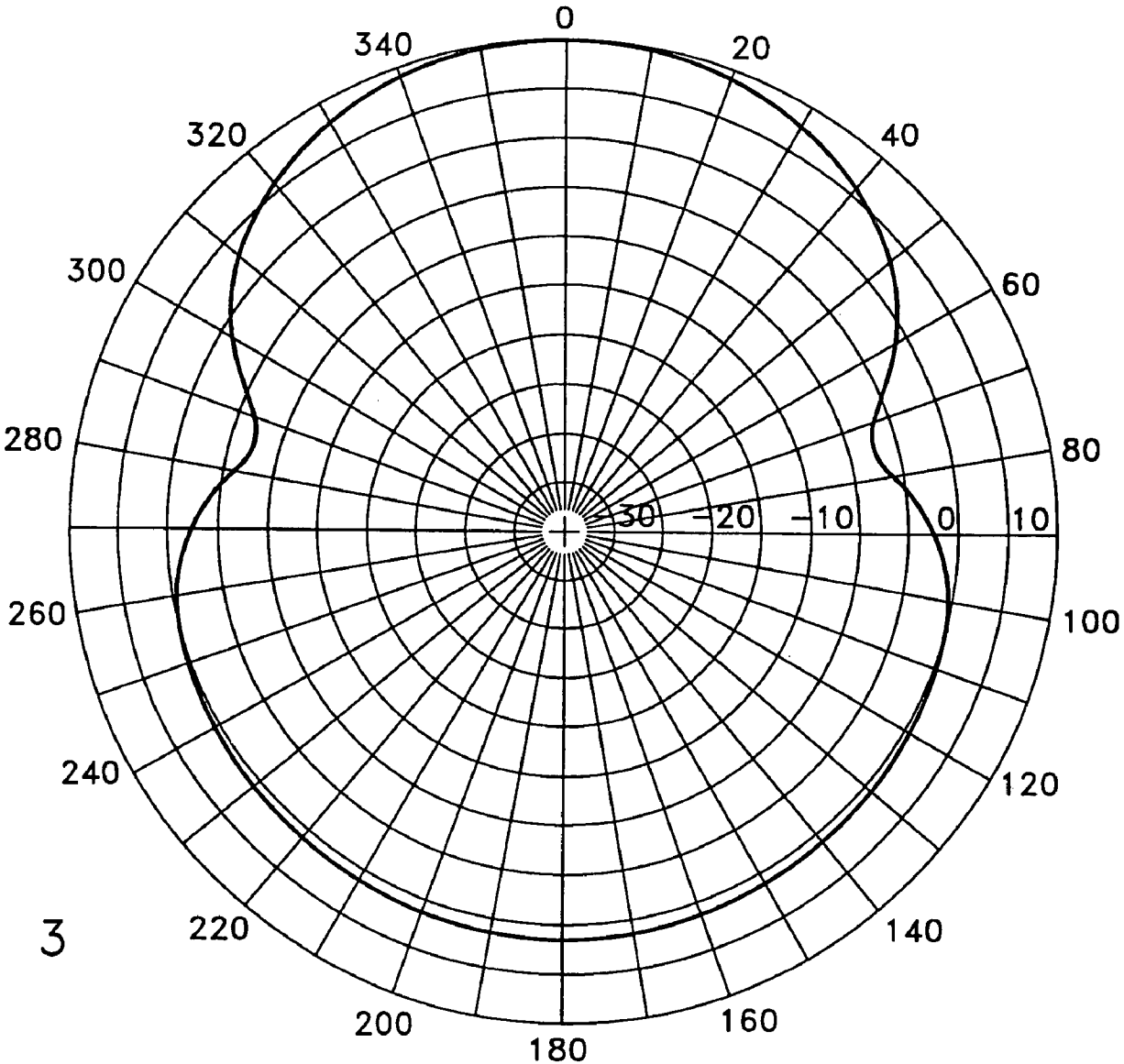
FIG. 3 is a radiation pattern plot for the first embodiment of the present invention.
Figure 4:
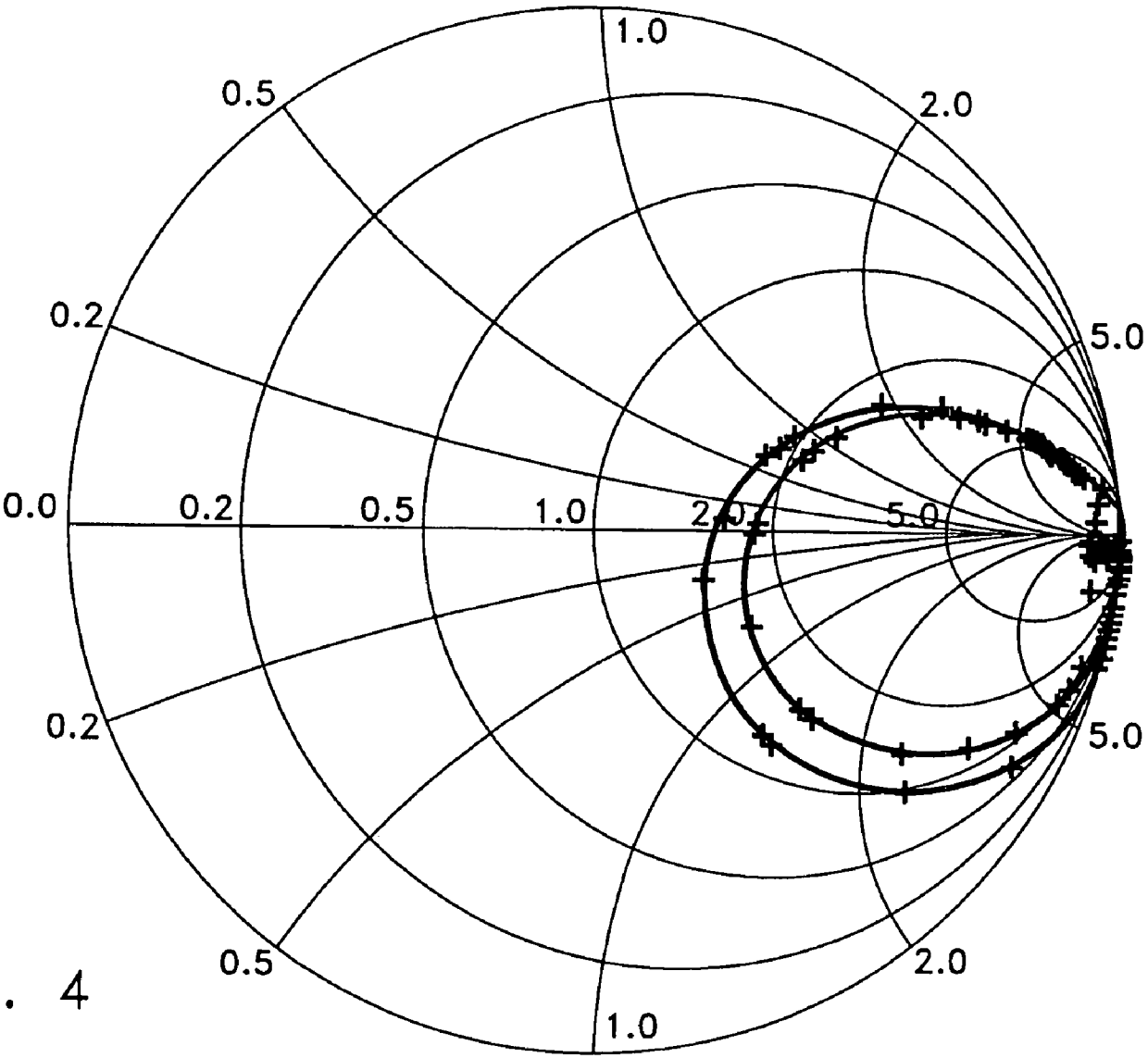
FIG. 4 is an impedance plot for the first embodiment of the present invention.

Referring to FIG. 3 it can be seen from the illustrated radiation pattern plot that the open Yaggi antenna 20 patterns near 1 wavelength at 1 GHz behave similarly to the Yaggi antenna 10. Unidirectional patterns exist over a small bandwidth. Referring to FIG. 4 it can be seen from the illustrated impedance plots that the basic dipole impedance locus remains the same with the addition of reflectors and directors. Only the parasitic resonance/anti-resonance loops are added. The desired objective of eliminating the shunting effects of the reflectors and directors is achieved.

One concern with this embodiment of the open Yaggi 20 is that the desired patterns where the parasitic resonance/anti-resonance loops occur, in the area where the reflector and directors are near 0.5 wavelengths long, occur where the impedance of the dipole is large at a one wavelength anti-resonance. Normally, a dipole is used where its impedance is at 0.5 wavelengths resonance, where its impedance is near a usable 50 ohms. With this in mind, a second embodiment of open Yaggi antenna is presented herein.

Figure 5:
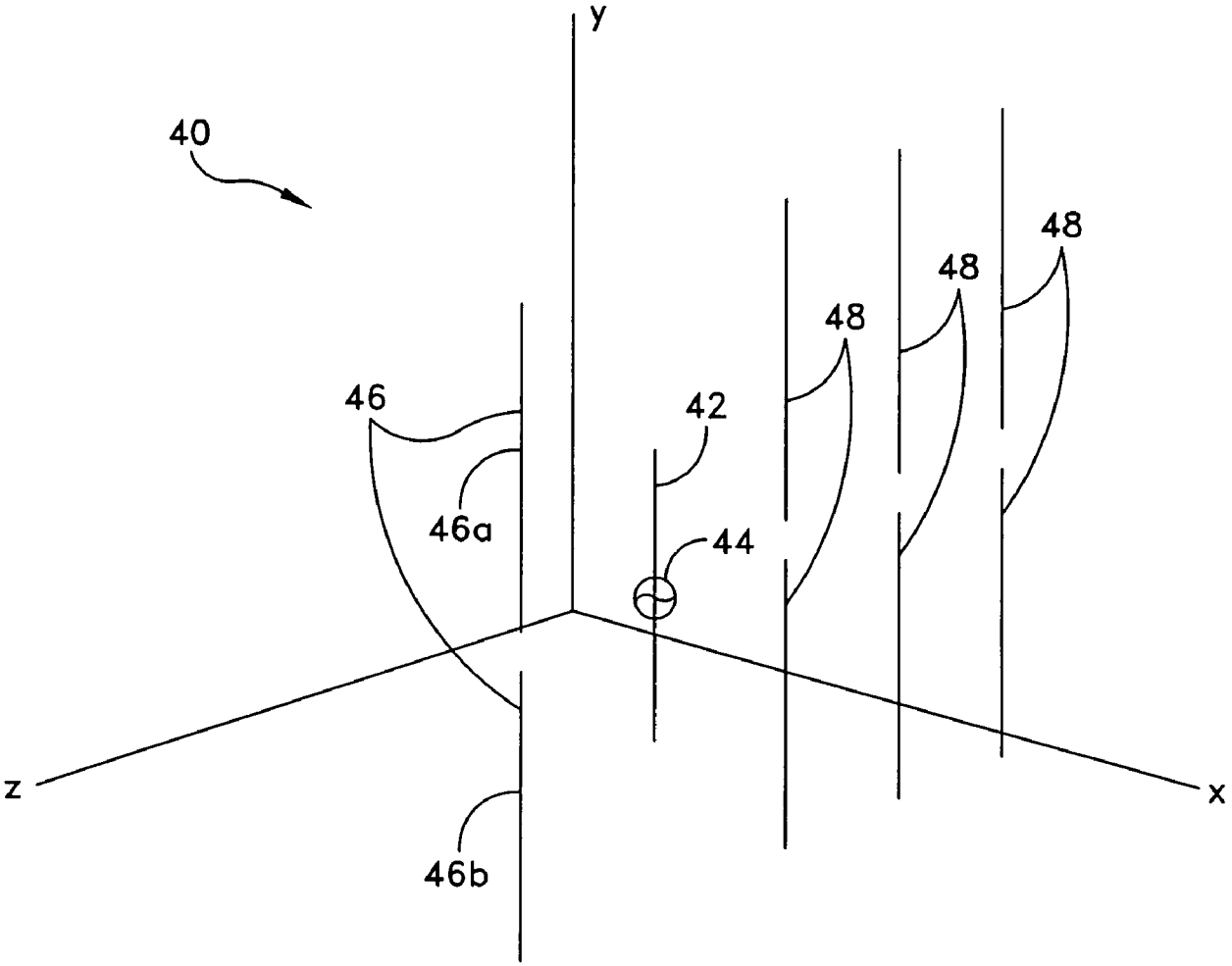
FIG. 5 illustrates a second embodiment of the present invention, an open yaggi antenna.

Referring to FIG. 5, there is shown a second embodiment of the present invention, an "open Yaggi" antenna 40. The open Yaggi antenna 40 also includes a driven element 42, which is a dipole having a feed point 44, a two piece reflector element 46 and one or more two piece director elements 48 all arranged on the same plane of the antenna axis an equal distance apart. For purposes of illustration the open Yaggi antenna 40 has three director elements 48, however, the invention is not limited to this number. The open Yaggi antenna 40 is also designed to avoid the shunting effects of the parasitic elements on the dipole by opening up the reflector element 46 and the director elements 48 in line with the feed point 44 of the dipole 42 thereby creating a gap along the axis of the feed point 44. To maintain the reflective properties of the reflector element 46, and the directive properties of the director elements 48, both types of elements are designed in two separate parts of equal length. The combined length of each two piece reflector or director element is twice the length of the single piece element of the prior art Yaggi antenna 10 as illustrated in FIG. 1. For example reflector element 46 is a combination of elements 46*a* and 46*b* whose combined length is equal to twice the length of reflector element 16.

In comparison to open yaggi antenna 20, the open yaggi antenna 40 has the following dimensions. The driven element 42 dipole is positioned vertically. One difference, however, is that the length of the driven element has been reduced in length from 1.0 wavelengths at 1 GHz to 0.5 wavelengths at 1 GHz. Using this design, the dipole can now be at 0.5 wavelengths resonance when the reflector and directors are near 0.5 wavelengths long.

Figure 6:
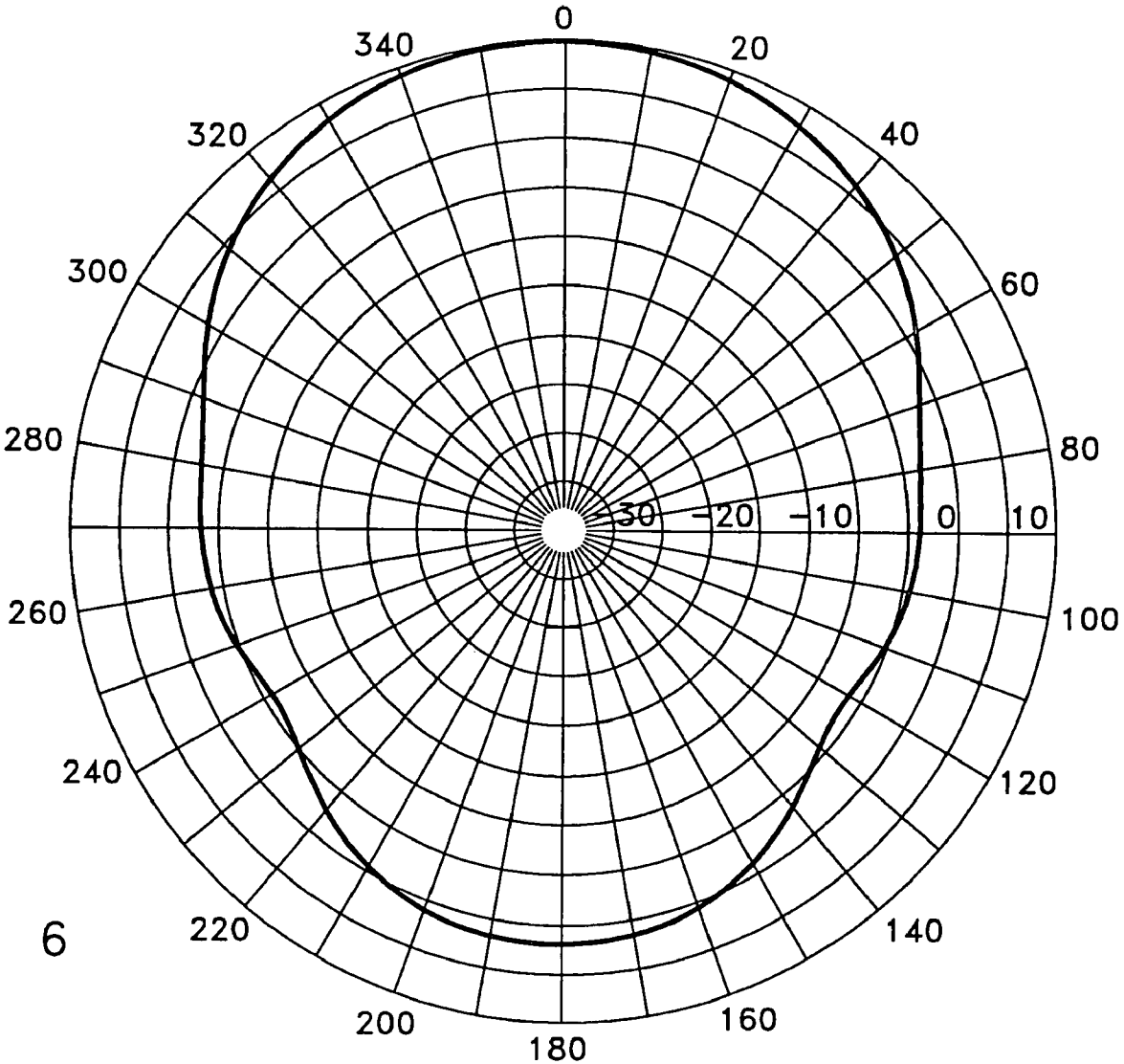
FIG. 6 is a radiation pattern plot for the second embodiment of the present invention.

Referring to FIG. 6 it can be seen from the illustrated radiation pattern plot that the open Yaggi antenna 40 patterns near 1 wavelength at 1 GHz behave similarly to the Yaggi antenna 10. Unidirectional patterns exist over a small bandwidth.

Figure 7:
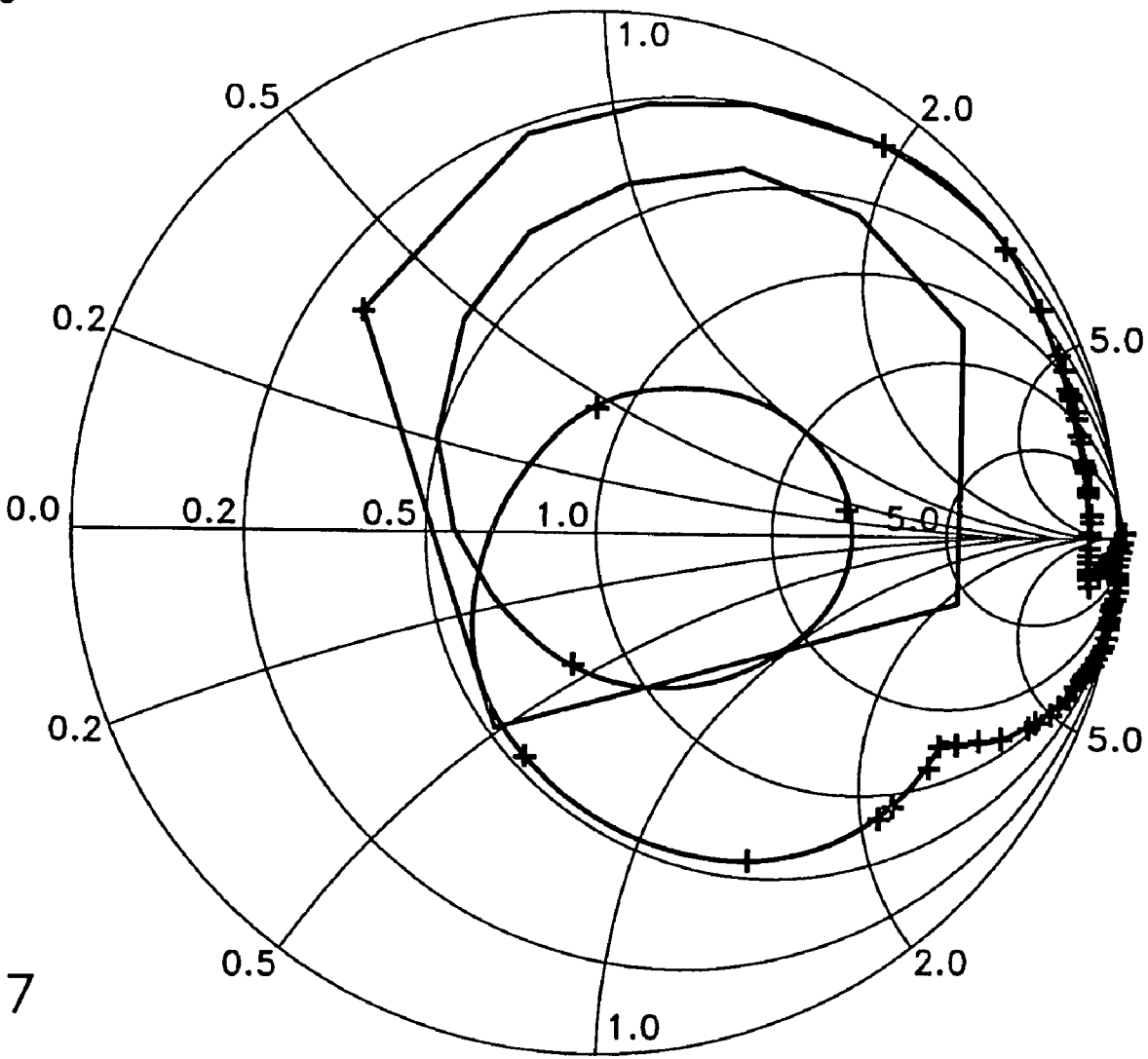
FIG. 7 is an impedance plot for the second embodiment of the present invention.

Referring to FIG. 7, the impedance plots illustrate the desired unidirectional patterns about 0.5 wavelengths at 1 GHz occur with an impedance near the original 0.5 wavelength resonance impedance of the dipole. Only resonance/anti-resonance loops are added to the impedance locus.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A Yaggi antenna array comprising:

a dipole having a feed point said dipole being a driven element of the array;

a reflector element positioned parallel to and on a first side of the driven element wherein said reflector element has a non-electrical contact gap in line with said feed point; and at least one director element positioned parallel to and on a second side of the driven element wherein each of said at least one director element has a non-electrical contact gap in line with said feed point.

2. The antenna in accordance with claim 1 wherein the driven element, the reflector element, and the at least one director element are all an equal distance apart.

3. The antenna in accordance with claim 2 wherein the driven element, the reflector element, and the at least one director element are all an equal distance apart of 0.1 wavelengths at 1 GHz.

4. The antenna in accordance with claim 3 wherein said driven element has a length of 1.0 wavelengths at 1 GHz and has a diameter of 0.005 wavelengths at 1 GHz.

5. The antenna in accordance with claim 4 wherein said reflector element is comprised of two separate elements of equal length, a first half reflector element and a second half reflector element, wherein the first half reflector element is a half wavelength long at 1 GHz and the second half reflector element is a half wavelength long at 1 GHz, wherein the gap between the first half reflector element and the second half reflector element is 0.025 wavelengths at 1 GHz.

6. The assembly in accordance with claim 5 wherein said at least one director element is comprised of two separate elements of equal length, a first half director element and a second half director element, wherein the first half director element is a half wavelength long at 1 GHz and the second half director element is a half wavelength long at 1 GHz. wherein the gap between the first half director element and the second half director element is 0.025 wavelengths at 1 GHz.

7. The antenna in accordance with claim 3 wherein said driven element has a length of 0.5 wavelengths at 1 GHz and has a diameter of 0.005 wavelengths at 1 GHz, wherein said dipole is 0.5 wavelengths resonance when the reflector and directors approach 1.0 wavelengths long.

8. The antenna in accordance with claim 7 wherein said reflector element is comprised of two separate elements of equal length, a first half reflector element and a second half reflector element, wherein the first half reflector element is a half wavelength long at 1 GHz and the second half reflector element is a half wavelength long at 1 GHz, wherein the gap between the first half reflector element and the second half reflector element is 0.025 wavelengths at 1 GHz.

9. The assembly in accordance with claim 7 wherein said at least one director element is comprised of two separate elements of equal length, a first half director element and a second half director element, wherein the first half director element is a half wavelength long at 1 GHz and the second half director element is a half wavelength long at 1 GHz. wherein the gap between the first half director element and the second half director element is 0.025 wavelengths at 1 GHz.

* * * * *